United States Patent [19]

Alissandratos

[11] 4,415,211

[45] Nov. 15, 1983

[54] BRUSH HOLDER

[76] Inventor: Tacko Alissandratos, P.O. Box 606, Tarpon Springs, Fla. 33589

[21] Appl. No.: 320,372

[22] Filed: Nov. 12, 1981

[51] Int. Cl.[3] ..... A47B 17/00; A47G 19/26

[52] U.S. Cl. ..... 312/206; 312/245; 312/284; 312/326

[58] Field of Search ..... 312/206, 245, 242, 284, 312/326, 329, 305, 229

[56] References Cited

U.S. PATENT DOCUMENTS

| | | | |
|---|---|---|---|
| D. 92,020 | 4/1934 | Rodstein et al. | 312/329 |
| 1,858,778 | 5/1932 | Horton | 312/284 |
| 1,866,001 | 7/1932 | Amelotte | 312/206 |
| 1,952,686 | 3/1934 | Sakier | 312/206 |
| 2,254,431 | 9/1941 | Levine | 312/229 |
| 2,520,380 | 8/1950 | Wegman | 312/229 |
| 2,965,429 | 12/1960 | Stanger | 312/242 |
| 3,067,822 | 12/1962 | Hattenhauer | 312/242 |
| 3,211,509 | 10/1965 | Sender | 312/329 |
| 3,220,791 | 11/1965 | Pokryfke et al. | 312/326 |
| 3,942,669 | 3/1976 | Savage, Jr. | 312/245 |
| 4,033,650 | 7/1977 | Alissandratos | 312/242 |
| 4,084,867 | 4/1978 | Putt et al. | 312/229 |
| 4,189,195 | 2/1980 | Turney et al. | 312/245 |
| 4,317,605 | 3/1982 | Alissandratos | 312/206 |

*Primary Examiner*—Victor N. Sakran
*Attorney, Agent, or Firm*—Edwin E. Greigg

[57] ABSTRACT

An improved wall mounted enclosure device for a sanitary brush having a telescopically extensible handle and a rigid head at one end with its bristle face inclined with respect to the axis of said handle. A flange surrounds a portion of the handle adjoining said head adapted to suspend said brush from a bracket on the door of said enclosure device with respect to the pivotal mountings of the door thereof so as to maintain said door in closed position over said sanitary brush when not in use and to expose the brush for use. Said improved device including a housing which encloses a rear housing and is mounted to a wall surface.

3 Claims, 8 Drawing Figures

FIG. 1
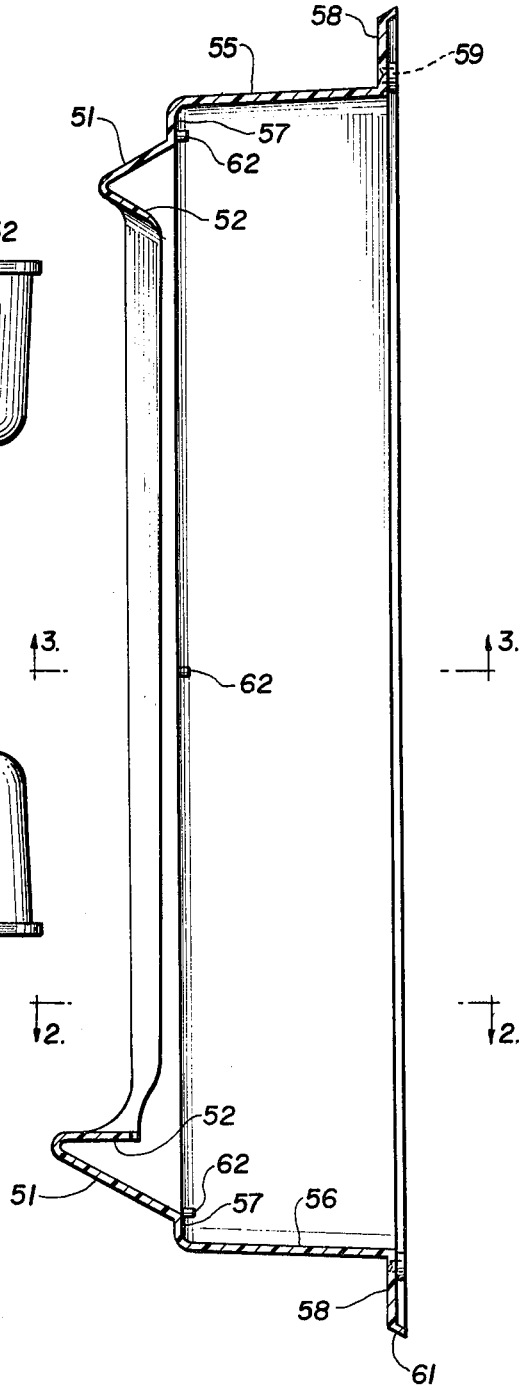
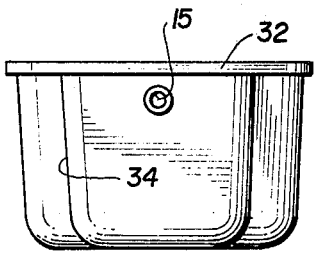
FIG. 6
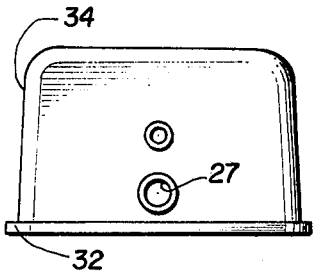
FIG. 7

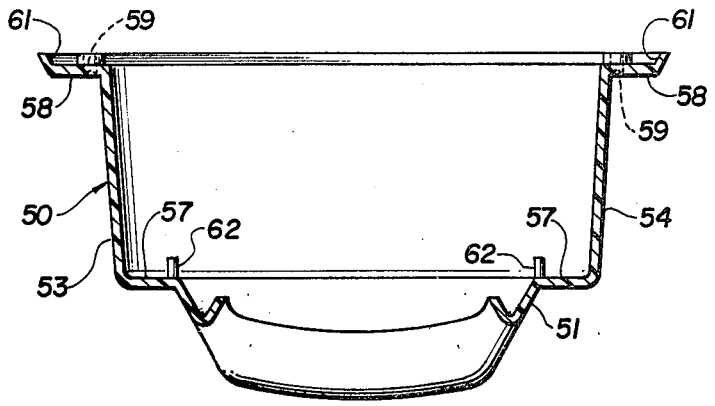
FIG. 2
FIG. 3
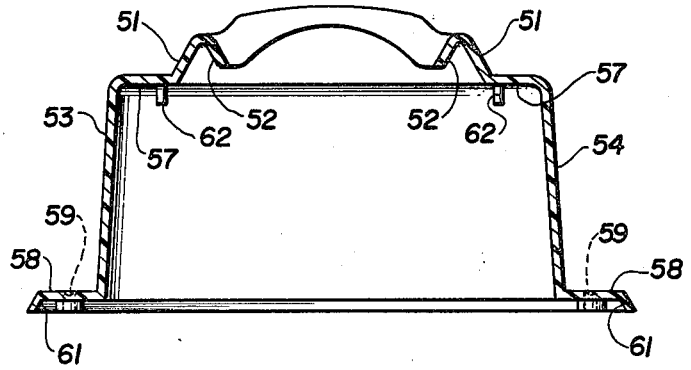
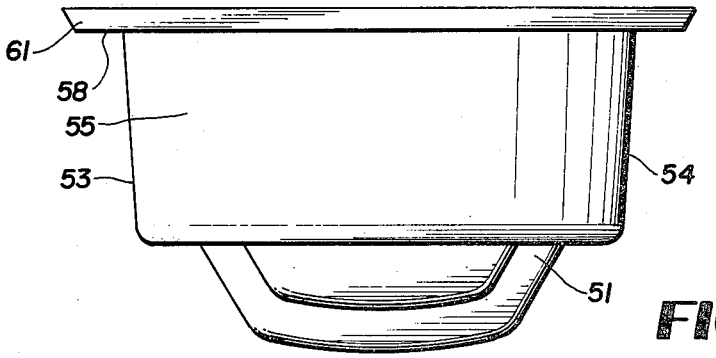
FIG. 4

BRUSH HOLDER

CROSS REFERENCE TO RELATED APPLICATION

This application is an improvement over the brush holder set forth in application Ser. No. 179,400 filed Aug. 19, 1980, which is incorporated herein by reference.

BACKGROUND OF THE INVENTION

Heretofore devices of this general type, while necessary, have been usually equipped for a brush having a long handle and as small a container as possible because of its use and appearance. As the device has been necessarily portable it is usually placed on the floor of the bathroom adjacent its source of most frequent use which has proven unsuitable, unsafe and unsightly. U.S. Pat. No. 4,033,650 is directed to a wall mounted brush holder similar to the present invention of which this invention is an improvement. The improved brush holder includes an outer housing secured directly to the wall so that it protrudes outwardly from the wall and contains therein a brush holder.

OBJECT OF THE INVENTION

As is pointed out above, the instant invention is directed to an improved construction and arangement of parts that have proved both convenient and economical for more frequent use of the device by the average housewife to maintain her bathroom in a more desirable sanitary condition. The construction of the device as a whole is such that it is more practical, safe and convenient to locate and maintain in a bathroom for the purpose stated. The frequently useable brush is normally unnoticeable in its convenient, yet hidden wall closure, when not in use. This invention comprises an easily assembled device of simple construction and with a hand grip for revolving the brush holder enclosure door.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 is a cross sectional view of a housing for mounting a brush holder to a wall surface;

FIG. 2 is a sectional view of the housing shown in FIG. 1 along line 2—2;

FIG. 3 is a different sectional view of the housing of FIG. 1 along line 3—3;

FIG. 4 is a top view of the housing shown in FIG. 1;

FIG. 6 is a top view of the rear housing;

FIG. 7 is a bottom view of the rear housing;

DESCRIPTION OF THE PREFERRED EMBODIMENT

Referring now to FIG. 1, it will be noted that the wall mounted toilet bowl brush holder includes a rear housing, a front enclosure housing and a rotatable brush holder enclosure door supported within the rear housing. The toilet bowl brush holder is preferably constructed of a material which may be colored to match the tile of the bathroom wall in which it is to be mounted. It is obvious that this housing may be constructed of materials such as plastic, sheet or cast metal, a baked clay-like substance, etc., which is recessed to support and enclose the sanitary brush 11.

Figure 5:
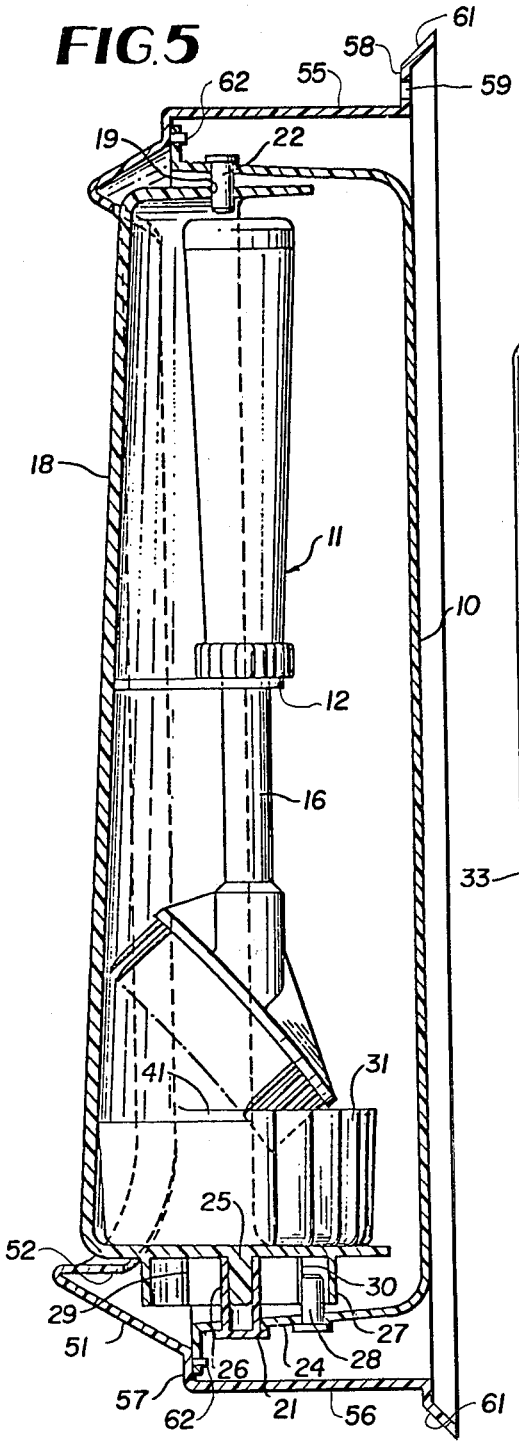
FIG. 5 is a cross sectional view of the housing and brush holder mounted in the housing.

The brush 11 is supported on a revolving closure door 18 which is semicircular in cross section with a circular bottom, including a bracket-like shelf 12 integral with the door and includes a front entrance slot and is depressed around its inner side edges to provide a suitable seat for retaining the lower tubular handle section 16 of the sanitary brush. The body of the housing is normally closed across the front when the brush is not in use by the pivotally mounted brush holder enclosure door 18, the body of the brush holder enclosure door 18 is centrally recessed along its length in opposition to the recessed body of the rear housing 10 when in the normal closed position to support the sanitary brush 11 and to enclose the same within the recessed body of the rear housing 10. The rear housing is formed by rectangular-like ends, sides and bottom to form an open rectangular shell. The upper and lower pivotal mountings 20 and 21, respectively, for the enclosure door 18 are best shown in FIG. 5. The upper pivotal mounting 20 includes a pin 22 which extends through a hole 15 in the upper end of the rear housing 10 into a hole 19 in the closure door 18 about which the upper end of the door pivots. The lower pivotal mounting 21 of the door 18 is mounted in the bottom closure wall 24 of rear housing 10. The bottom of the closure door 18 is made with an integral pivot pin 25 which fits into a pin bushing 26 inserted through a hole 27 in the bottom of the rear housing 10 on the axis of the pin 22 at the top of the housing. The bottom of the closure door is also provided with a downwardly extending arcuate semi-circular skirt 27. A stop pin 28 is inserted through the bottom wall of the housing toward the bottom of the enclosure door. The closure door rides on and rotates about the pin bushing 26 and is provided with downwardly extending spaced ribs 29 and 30 which protrude from the skirt and serve as stops. The ribs 29 and 30 cooperate with the stop pin 28 in order to stop the enclosure door in either an open or closed position. The brush 11 will thus be supported in a good position for its removal from the bracket shelf 12 spanning the recess in the side of enclosure door 18. A drip cup 31 is shown mounted on the bottom floor of the pivotal door 18 so as to prevent any dripping from the brush, after use, contaminating the lower or bottom pivotal point 21.

Figure 8:
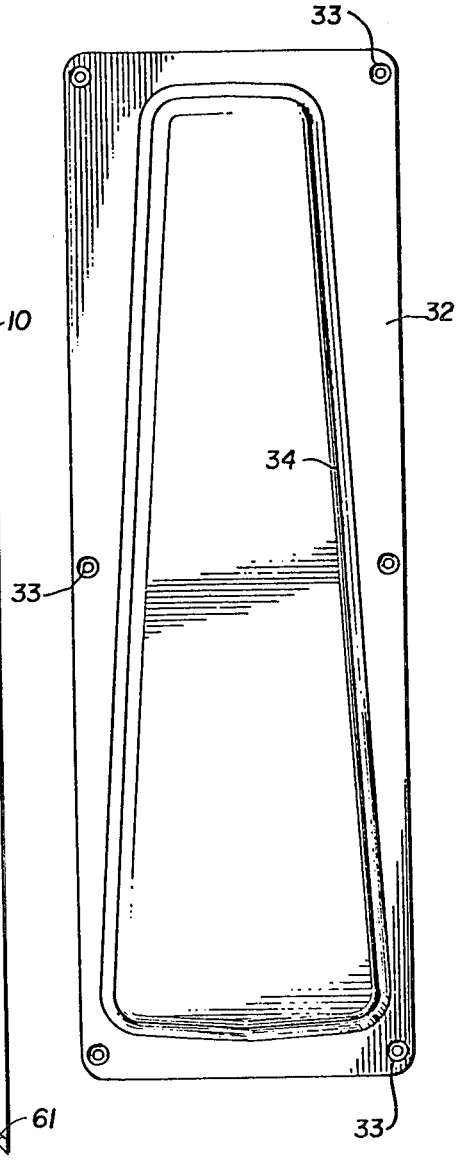
FIG. 8 is a front view of the housing with the rotatable brush holder door in its closed position.

FIG. 6 is a top view of the rear housing 10 which more clearly shows the hole 15 through which the pivot pin is inserted and the general shape of the rear housing looking from the top. FIG. 7 illustrates a bottom view of the rear housing, more clearly showing the general shape of the rear housing as looking from the bottom. FIG. 8 is a front view illustrating the view from the front. As seen in the views of FIGS. 6–8, the rear housing is provided with a flange 32 extending outwardly from the main body. As seen in FIG. 8, the side walls 34 converge toward each other from the bottom toward the top where the angle of convergence is about 30° with the vertical. The corners are rounded into smooth lines as seen in FIGS. 6–8. The flange is provided with non-threaded holes 33 which are countersunk from the back side by which the rear housing is secured to the front enclosure.

The brush holder is assembled prior to installation on the wall of a bathroom. In assembly, the rotatable brush holder enclosure door is held in place in the rear housing so that the downwardly protruding stops are outwardly of the stop pin. The upper pivot pin is inserted through the holes in the rear housing into the hole in the upper wall of the brush holder enclosure door. The bottom bushing is inserted through the hole in the bottom of the rear housing so that the downwardly protruding integral pivot pin on the brush holder enclosure door is inserted into the bushing. The stop pin can now be inserted if it was not previously inserted. The upper pivot pin, the bottom bushing, and the stop pin all have a tight fit in the rear housing so that they will be retained in the housing. Subsequent to securing the brush holder enclosure door in the rear housing, the front housing is secured to the rear housing. In order that the screws do not show through the front cover, the screws are passed through the back housing and screwed into the flange in the front cover. The flange on the front cover has an angular edge so that the flange edge fits over and to the outside of the flange circumference on the rear housing.

The width and length of the recessed portion of the rear housing is made with a width and length such that the brush holder will fit into the area of three regular wall tiles. Therefore, by removing three wall tiles and cutting away the wall board behind the three tiles, the brush holder can be secured to the wall. In order to secure the device to the wall, a strip of protected mastic can be applied to the flange of the rear housing and the holder secured to the wall by removal of the protective coating and pressing the brush holder mastic to the wall. Therefore, the brush holder can be secured to the wall with very little effort and with minimum tools.

FIGS. 1–4 illustrate the particular structure of the outer housing. The general shape of the outer housing 50 includes the front wall 51 an horizontal portion 52, side walls 53 and 54 and top and bottom walls 55 and 56 which form a recessed enclosure having a rectangular shape in cross-section. As shown in FIGS. 1–3 the wall 51 joins with a straight wall portion 57 that extends to the side, top and bottom walls. The side, top and bottom walls join an outwardly extending flange 58 which is provided with apertures 59 and with an angular end 61. The straight wall portion 57 includes rearwardly extending pins 62 which are so positioned to extend into the holes 33 on the back housing for securing the rear housing within the enclosure 50.

The outer housing 50 as shown in FIGS. 1–4 mounts the rear wall and rotatable brush holder such that they can be mounted directly to the wall surface without any recess for the back housing. The walls, top and bottom of the front enclosure 50 extend along the walls of the rear housing, so that the flange 58 is secured to the wall which encloses the rear housing and brush holder within the front enclosure 50.

The brush holder including the outer housing shown in FIGS. 1–4 can be used for mounting the brush holder directly to the wall surface. The holes 33 in the rear housing may be threaded so that a front cover as shown in application Ser. No. 179,400 filed Aug. 19, 1980 may e secured to the rear housing by decorative screws with the flange of the rear housing secured in place by a mastic as set forth therein. By use of an outer housing shown by FIGS. 1–4 the rear housing is held in place within the outer housing 50 by use of the pins 62 and the outer housing 50 is secured to the wall by use of screws that pass through apertures 59 in flange 58. The rear wall of the rear housing would be juxtaposed the wall upon which the brush holder is mounted.

As can be seen from this improvement, brush holders can be recessed or wall mounted by use of different front covers. The rear housing and brush enclosure door are the same for either mounting. Only the front enclosure is changed for the different mounting arrangement.

Obviously, the brush holder can be used for other purposes than for a toilet brush. Likewise, it may be made of any desired size to accommodate the brush of interest, such as tooth brushes. Further, the enclosure door may have more than one supporting shelf each of which may support more than one brush.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An improved wall mounted enclosure device for mounting at least one brush and the like to a wall surface comprising:

a back housing, said back housing including a recessed cavity formed by side, bottom, and top walls, said side walls converging toward each other from said bottom walls toward said top wall, a flange extending outwardly from said top, bottom and side walls in the same vertical plane, said flange including mounting apertures therein;

a recessed brush holder enclosure door rotatably supported by said rear housing;

said enclosure door including top and bottom horizontally extending parallel flanges, said top flange including an aperture therein, said bottom flange including a downwardly extending first pivot pin for mounting said enclosure door to said back housing for pivotable motion therein, and spaced ribs extending downwardly from said bottom flange and equally spaced from said first pivot pin;

a second pivot pin extending through said top wall of said rear housing into said aperture in said enclosure door and a bushing extending through said bottom wall of said rear housing for receiving said first pivot pin for pivotably mounting said enclosure door within said back housing and said front enclosure; and an unexposed stop means extending upwardly from said bottom wall of said rear housing for cooperating with said spaced ribs on said enclosure door for positioning said enclosure door in either an open or closed position, at least one shelf rigidly supported by said enclosure door and extending across the recess therein for securing at least one brush on said recessed brush holder enclosure door;

the improvement comprising:

an outer housing arranged relative to said back housing and said enclosure door, said outer housing including a central opening formed by an outwardly extending wall on an angle relative to a vertical wall, and an inwardly extending wall extending toward a plane formed by said vertical wall, said central opening converging toward the top portion and partially enclosing said enclosure door;

said outer housing including top, bottom and side walls extending from said vertical wall, that surrounds said back housing;

said top, bottom and side walls including outwardly extending flanges for securing said outer housing to a wall surface; and means for securing said back housing to said outer housing;

whereby said back housing may be secured to said outer housing and said outer housing may be secured to a wall with said back housing unexposed wherein said outer housing encloses said rear housing and said at least one brush when said brush holder is in the closed position and exposes said at least one brush when said brush holder is in the open position.

2. An improved wall mounted enclosure device as claimed in claim 1 wherein said outer housing includes rearwardly extending pins by which said back housing is secured with said front enclosure.

3. An improved wall mounted enclosure device as claimed in claim 2 in which said outwardly extending flanges have apertures by which said device is secured to a wall surface.

* * * * *